United States Patent [19]

Cassia

[11] Patent Number: 4,886,192

[45] Date of Patent: Dec. 12, 1989

[54] LIQUID SOAP DISPENSER

[75] Inventor: Antonio M. Cassia, Milan, Italy

[73] Assignee: Steiner Company, Inc., Chicago, Ill.

[21] Appl. No.: 56,352

[22] Filed: May 27, 1987

Related U.S. Application Data

[63] Continuation of Ser. No. 832,419, Feb. 24, 1986, abandoned.

[30] Foreign Application Priority Data

May 20, 1985 [IT] Italy ..... 20792 A/85

[51] Int. Cl.[4] ..... B67D 5/06

[52] U.S. Cl. ..... 222/181; 222/207; 222/214

[58] Field of Search ..... 222/180, 181, 185, 207, 222/209, 212, 213, 214, 215, 80, 81, 82, 83.5, 88, 90

[56] References Cited

U.S. PATENT DOCUMENTS

| | | | |
|---|---|---|---|
| 2,772,817 | 12/1956 | Jauch | 222/207 |
| 4,036,406 | 7/1977 | Jesperson et al. | 222/181 |
| 4,133,457 | 1/1979 | Klassen | 222/212 |
| 4,146,156 | 3/1979 | Cassia | 222/181 |
| 4,306,667 | 12/1981 | Sedam et al. | 222/481 X |
| 4,394,938 | 7/1983 | Frassanito | 222/207 |
| 4,429,812 | 2/1984 | Steiner et al. | 222/181 |
| 4,489,857 | 12/1984 | Batlas | 222/207 X |
| 4,493,440 | 1/1985 | von Buelow et al. | 222/181 X |
| 4,515,294 | 5/1985 | Udall | 222/207 X |
| 4,560,093 | 12/1985 | Cassia | 222/181 |

FOREIGN PATENT DOCUMENTS

| | | |
|---|---|---|
| 2341259 | 3/1975 | Fed. Rep. of Germany . |
| 2151586 | 4/1973 | France . |
| 2365997 | 4/1978 | France . |
| 2520702 | 8/1983 | France . |

*Primary Examiner*—Joseph J. Rolla
*Assistant Examiner*—Kenneth Noland
*Attorney, Agent, or Firm*—Emrich & Dithmar

[57] ABSTRACT

An improved liquid soap dispenser is described which essentially comprises a L-shaped wall bracket provided with a lever and piston device to actuate a dispensing nozzle, connected to a tank with a cover mounted on the bracket. The dispensing nozzle is directly fastened to the tank by means of a ring which is preferably formed to incorporate a valve element of the nozzle. The tank may have an upstanding portion for mounting and opening a disposable soap cartridge. As an alternative the liquid soap can also be contained directly in the tank, by pouring the same in bulk into the tank.

13 Claims, 3 Drawing Sheets

LIQUID SOAP DISPENSER

This is a continuation of application Ser. No. 832,419, filed Feb. 24, 1986, now abandoned.

BACKGROUND OF THE INVENTION

The present invention relates to an improved liquid soap dispenser, of the type in which, upon a simple manual operation of a lever, a predetermined quantity of liquid soap is delivered from a container and received by the user's hands.

Dispensers of this type are well known and have been used and widely installed in public lavatories and toilets in public places, such as restaurants, schools, hospitals, trains, etc. However, the prior art liquid soap dispensers have shown a number of inconveniences, some of which have been overcome by the use of a dispensing nozzle or valve-including pump cartridge according to the prior Italian patent application No. 22295 A/84, corresponding to U.S. patent application Ser. No. 680,822, filed Dec. 12, 1984, now abandoned, of the same applicant. The device therein described and claimed affords a more reliable operation of the dispenser, with a fixed quantity of liquid soap being always supplied, irrespective of the mass of liquid soap being in the container, while at the same time preventing undesired dripping of the product, when no pressure is exerted onto the lever.

However other difficulties and disadvantages are still present in the liquid soap dispensers known in the art. For example, the product container is usually made integral with the back support to be fastened to the wall resulting in certain constructional complications because the dispensing nozzle being clamped to the support or container is not easy to service or replace. For example, it could be difficult to feed the product directly into the dispenser container by pouring the liquid from a big supply tank because the container is so close to the wall. Some difficulties may also arise when it is required to loosen screws for the replacement of parts, particularly the dispensing nozzle or cartridge pump, which are usually rusted and/or encrusted with the soap.

SUMMARY OF THE INVENTION

It is therefore an object of the present invention to provide an improved liquid soap dispenser having the liquid container tank separate from the support structure fixed to the wall, this structure being of reduced size and such that the tank can be mounted thereon in the simplest way, without screws or other fastening means.

Another object of the invention is to provide an improved liquid soap dispenser having the dispensing nozzle detachably connected to the tank, thus being readily replaceable.

Still a further object of the invention is to provide an improved liquid soap dispenser with a tank adapted to house a disposable sealed cartridge container of the product so that a given quantity of liquid is delivered through the dispensing nozzle upon each actuation thereof by means of a manual lever. In this case there can be provided means to prevent the direct feed of liquid product into the tank without using authorized cartridges suitable to cause the formation of a liquid reserve in the tank, thus allowing the continued dispensing of liquid soap even upon removal of an empty cartridge before the insertion of a fresh full one. Also, the cartridge container itself form part of the present invention, as will be described herein.

As an alternative, the dispenser tank could be directly fed with liquid soap from a supply tank without using disposable cartridges, because the tank can be easily removed from the support bracket during filling.

Further object, advantages and characteristics of the liquid soap dispenser according to the invention will be better understood from the following detailed description of the preferred embodiment, with reference to the drawings.

DESCRIPTION OF THE PREFERRED EMBODIMENT

Figure 1:
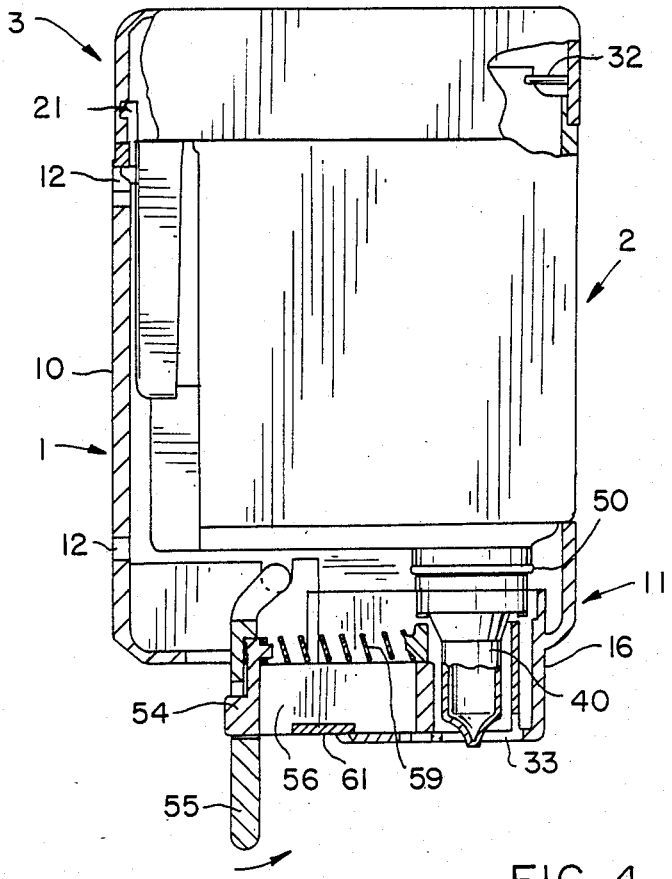
FIG. 1 shows a side view, partially in cross-section, of a dispenser unit according to the invention.

With reference to the drawings, the liquid soap dispenser according to the invention comprises, as main structural components, a support bracket 1, a tank 2 and a cover 3.

The support bracket 1 is substantially a L-shaped element with a vertical portion or rear plate 10 to be fixed to a wall such as by screws passing through holes 12, or also by adhesive strips (not shown) providing along plate 10. The support bracket 1 has a horizontal portion 11 which comprise a bottom wall 13 with side walls 14 and a front wall 14a for housing the tank 2. Centrally disposed along the bottom wall 13, at right angles with the rear plate 10 and the front wall is a central zone 15 defined by peripheral walls extending upward from the bottom wall 13 at a height lower than side walls 14, and downward at a position near to the front wall 14a. This zone 15 encloses various ribs, ledges, shoulders and holes to form the guides, seats and abutments for the dispensing pump actuating mechanism, as will be hereafter disclosed.

The tank 2 can be made conveniently of the same material as the bracket 1, preferably plastics like ABS, and in particular of the transparent type so as to allow that the level of liquid in the tank be viewed and checked from the outside. The shape of the tank 2 is such as to conform to the rear plate and side walls of bracket 1, wherein it is housed and rests by gravity, supported by the bottom wall 13. The tank 2 has a downward projecting portion 20, of circular cross-section, adapted to pass through an associated hole 30 forming the seat therefor in the bottom wall 13 of the above-mentioned zone 15 which includes downwardly extending walls 16.

A cover plate 3, of the same material as the tank 2, is adapted to be snap shut onto the tank, such as by having a recess 31 (FIG. 2) which cooperates with a corresponding hook-shaped member 21 of the tank 2 and an inwardly extending rib 32 to cooperate with a corresponding recess 22 of the tank.

Figure 2:
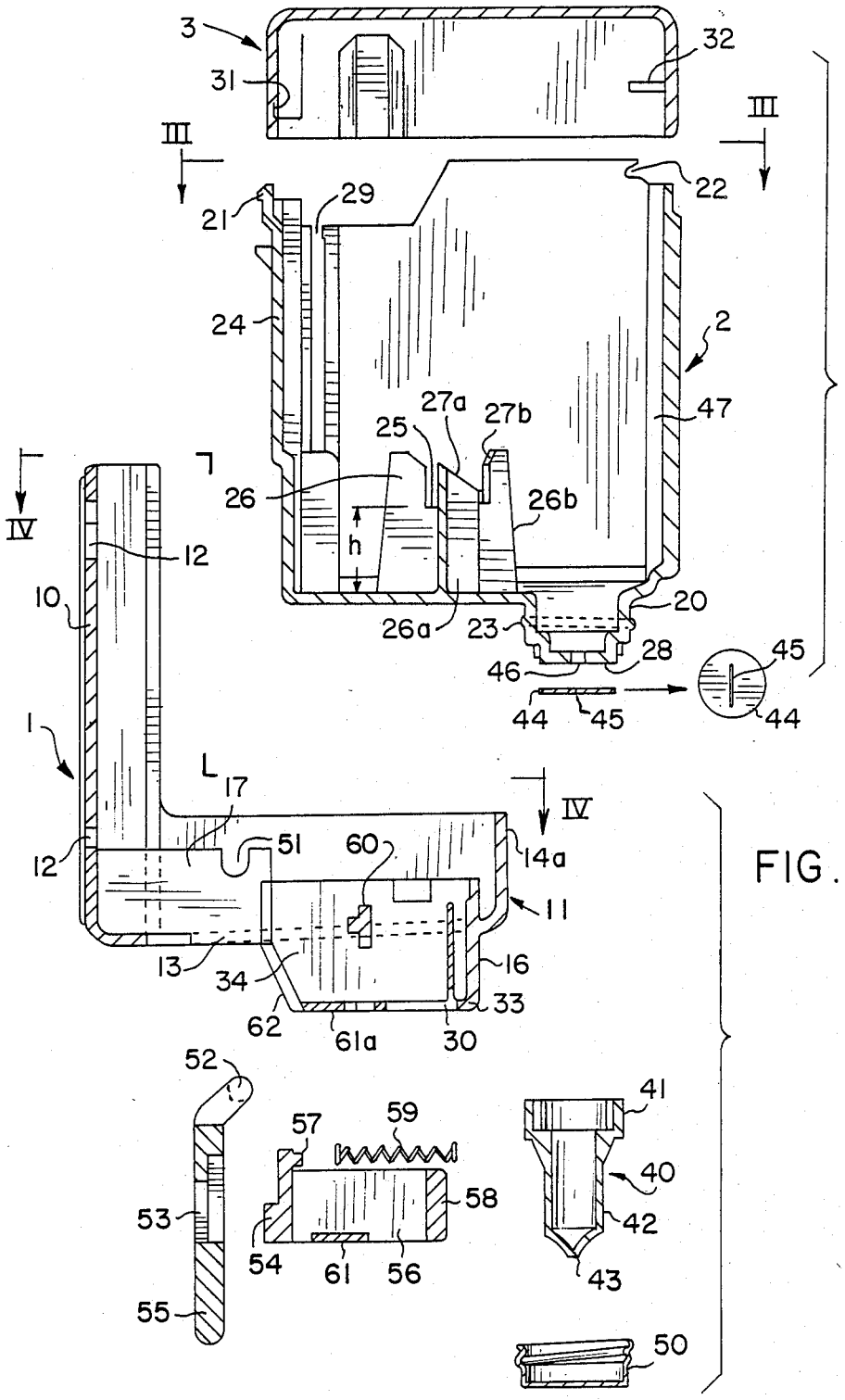
FIG. 2 shows an exploded view of the various parts forming the dispenser of FIG. 1.

According to the invention, the projecting cylindrical portion 20 of the tank 2 is adapted to be connected with a dispensing nozzle 40 having a valve including the diaphragm 44 of the type disclosed in my prior Italian patent application no. 22295 A/84. As illustrated, the nozzle 40 and valve 44 are connected to the portion 20 of tank 2 through an internally threaded ring 50. The ring 50 can be readily coupled to the tank portion 20 by means of a bayonet-type fitting, wherein the cylindrical portion 20 has a one-pitch external thread 23 as shown in FIG. 2. Since the upper portion 41 of nozzle 40 is of deformable character, it can be firmly fitted between the projection 20 and the outer ring 50.

It should be appreciated that the cartridge pump of the above-mentioned patent aplication is formed of three parts, one of which is the nozzle 40, a second one is a membrane or diaphragm 44 with a central slit 45 and the third one is a rigid disc with a central hole, which in this case is conveniently provided by the integral bottom 28 of the cylindrical portion 20 of the tank 2, with a central through hole 46 being coaxial with a slit 45 and the outlet aperture 43 of the nozzle 40.

Figure 3:
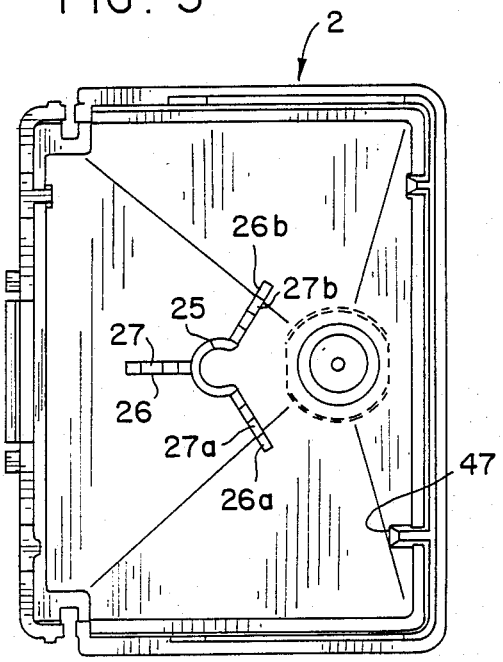
FIG. 3 shows a plan view of the tank of the dispenser seen in direction of the line 3—3 of FIG. 2.

In FIGS. 2 and 3 a first embodiment of tank 2 is represented which is adapted to be used in combination with a liquid soap supply cartridge 100, to show its position within tank 2. The cartridge 100, preferably made of plastics, of the disposable type, will be described more in detail in the following, with reference to FIG. 5.

With reference to FIGS. 2 and 3, it is seen that the tank 2, at a position between the cylindrical projection 20 and the rear wall 24, is formed with a tubular mounting 25 C-shaped in horizontal cross-section which extends itself to a certain height h from the bottom of tank 2 and is defined by a number (three in the drawings, referred to as 26, 26*a*, 26*b*) of upright ribs also extending from the tank bottom. The ribs 26-26*b* end at their top portion with inclined, corresponding faces 27, 27*a*, 27*b* at a level higher than said height h from the tank bottom. Such ribs 26-26*b* have the function of reinforcing or stiffening the C-shaped mounting 25 which has cutting edges for piercing the sealed cap 101 of cartridge 100 as it is caused to rest upside down on the support formed by the mounting 25, the ribs 26-26*b* also serving to guide the cartridge 100 into alignment and then engagement with cutting edges of mounting 25. The open portion or concavity of the C-shaped cross-section of the mounting is positioned facing toward the mouth of the downwardly directed cylindrical recess 20.

Figure 4:
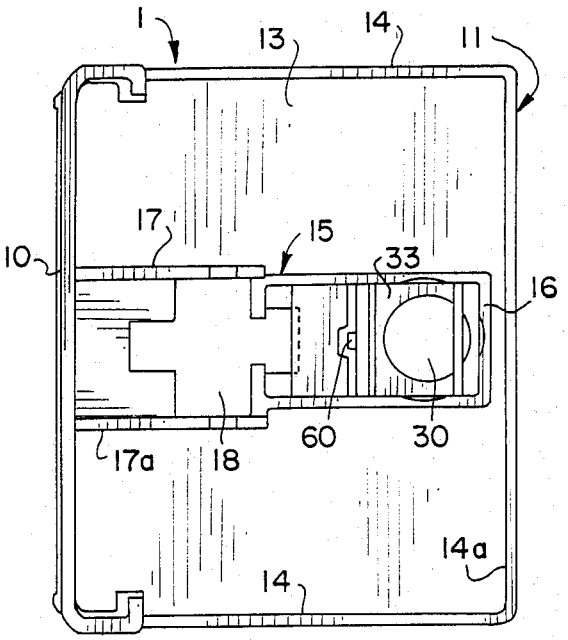
FIG. 4 shows a plan view of the dispenser with the tank removed, as seen in the direction of line 4—4 of FIG. 2.

Referring now to the horizontal section 11 of the bracket support 1, and in particular to said zone 15, the latter comprises, as seen from FIGS. 2 and 4, two parallel walls 17, 17*a* each having a rounded recess 51 for housing the pivot pin 52 of a lever 55 to be operated manually from the outside. Lever 55 to be cooperates with a sliding piston 56 having a pusher end 58 capable of exerting pressure onto the side wall 42 of the dispensing nozzle 40, as described in the above-mentioned prior patent application, so that a dosed amount of liquid product is delivered from the nozzle outlet 43. To this aim piston 56 may have, as shown, an end 54 opposite to end 58 shaped to fit in a correspondingly shaped aperture 53 in the lever body 55. As shown in the drawings an abutment 60 is provided, integral with the bracket 1 structure, against which one end of a spiral spring 59 is urged, having its second end fixed to or biased against a projecting portion 57 of piston end 54. However, any different type of return spring means could be provided between piston 16 and the bracket 1 body, such as a leaf spring integrally formed with the piston as an appendix thereof, being forced against a fixed portion of the dispenser, in particular of the bracket support.

Piston 56 is slidably mounted on a horizontal plate 33 underlying and parallel to the bottom wall 13, by means of cooperating guides 61, 61*a*. Lower plate 33 is connected to the bottom wall 13 through vertical walls 16 and an inclined wall 62 forming a stop for the forward oscillation of lever 55 in order to prevent an excessive pressure of piston 56 onto the nozzle wall 42 when the lever is caused to rotate in the direction of the arrow in FIG. 1 against the resistance of spring 59. When releasing the lever, it returns to the rest position of FIG. 1 under the action of the spring means, such as compressed spiral spring 59. During its path between these two end positions, the lever 52 protrudes outside of the bottom wall 13 through an aperture 18 which in FIG. 2 is represented to be in communication with a lower chamber 34 formed between bottom wall 13 and plate 33 wherein the piston 56 is slidably housed.

It appears from the description above and from the drawings that when a cartridge container 100 of liquid soap is located in the tank 2 between the ribs 26–26*b*, the cutting edge of the C-shaped mounting means pierces the closure cap 101 to open same to permit the liquid to flow out of the cartridge until the tank 2 is filled to height h, whereupon at each subsequent delivery of product through the nozzle 40, a corresponding liquid amount flows from the cartridge to keep the level h constant. When the cartridge 100 is empty, it can be readily replaced with a new one, but it is possible to continue using the dispenser in the meantime, since there is a mass of liquid available as a reserve covering the bottom of the tank 2 up to height h.

For commercial reasons, if, as it often happens, only supply cartridges containing a given type of liquid soap and thus supplied by a certain producer should be employed, these will have for example a particular configuration to which the inner shape of the tank 2 should be associated.

Figure 5:
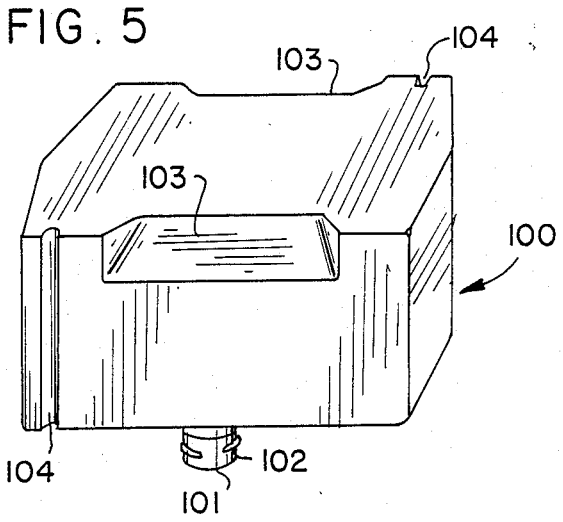
FIG. 5 shows a perspective view of a cartridge according to the invention, suitable to be used in association with the tank illustrated in the preceding figures.

With reference to FIG. 5, showing a cartridge 100 of a light plastic material, having a substantially parallelepiped shape with a liquid outlet neck 102 normally closed by a sealing cap 101 and two recesses 103 to make its grip easier, the cartridge 100 may show e.g. one or more grooves 104 (in number of two and mutually staggered in FIG. 5) which cause it to be suitable for use with correspondingly shaped tanks. Generally speaking at each combination of number, position and depth of the grooves 104 in the cartridges 100, the associated tanks 2 shall show a corresponding combination of ribs on their inner walls, such as the one referred to as 47 in FIGS. 2, 3 so as only a given type of cartridge can match with and be used in the tank of the dispenser.

Also to prevent using the tank 2 without any cartridges 100 at al, but merely by pouring therein the liquid in bulk from a supply container, long slits 29 (see FIG. 2) can be formed along at least one side wall of the tank from the top thereof down which terminate above the height h, thus preventing unauthorized use of the dispenser, because the liquid soap would flow from such slits, should soap be fed directly into the tank without the proper cartridge. The slits 29 can also have the further function of allowing the liquid level in the cartridge 100 to be observed and checked when the cartridge is of transparent material and the tank 2 is opaque.

The ribs **26–26*b* in combination with the slits 29 also prevent the use of unauthorized cartridges with the dispenser 1 because unauthorized (bootleg) cartridges will not fit into proper nesting position between the ribs 26–26*b*. The tops of the ribs 26–26*b* are just above the bottom of the slits 29 so that soap from a bootleg cartridge resting on the top of ribs 26–26*b* will fill to the bottom of the bootleg cartridge, above the bottom of slits 29, and leak out of the dispenser 1**.

Figure 6:
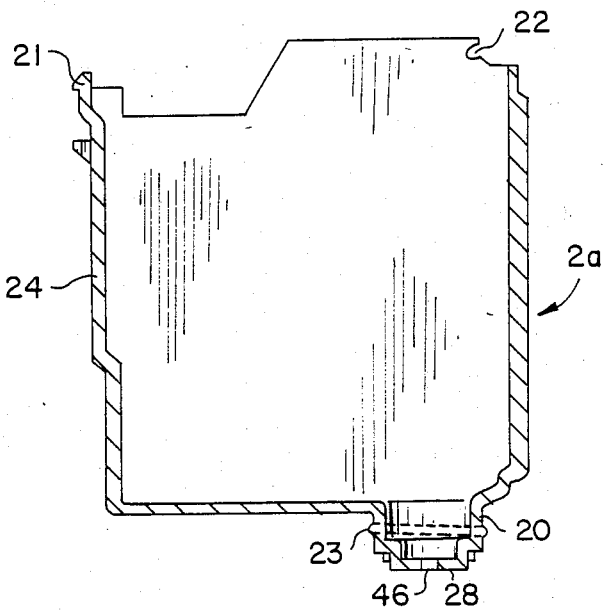
FIG. 6 shows a vertical cross-section view of an alternative embodiment of the tank for the dispenser according to the invention, suitable to be used without said cartridge container.

If bulk filling is permitted or desirable, then the tank would be constructed as illustrated in FIG. 6 wherein tank **2*a* is shown. Where the details of tank 2*a* are similar to those of tank 2, the same reference numbers have been used. The C-shaped cartridge closure mounting and cutting means 25 and the associated reinforcing means 26, 26*b*, 27, 27*b* are obviously missing and there are no slits 29 on the tank 2*a* lateral walls. In order to make bulk loading of dispenser tanks 2*a* the tank itself can be easily brought away from its position near the wall to which the dispenser is mounted, by simply removing it upward from its support bracket 1 and subsequently arranging the same thereon again with the nozzle 40, integral with the tank 2*a*, inserted in the hole bar 30 of the base 11. The replacement of the dispensing nozzle 40 in both the embodiments of the tank is accomplished with the coupling ring 50, by making one complete turn only, first in the unscrewing direction and then by screwing it again onto the new nozzle. The nozzles 40** are changed manually, without the need of tools.

Although the invention has been disclosed with particular reference to certain embodiments, further additions and/or modification being obvious to those skilled in the art can be made to the described embodiments without exceeding the scope of the invention itself.

I claim:

1. A liquid soap dispenser comprising a L-shaped bracket having a vertical rear plate adapted to be mounted on a wall and having a horizontal base having a bottom wall, two side walls and a front wall; a tank shaped to be supported on said bottom wall and housed within a space defined by said rear plate and said side walls and front wall, said tank having a hollow downwardly projecting portion of generally cylindrical shape having a substantially flat bottom with a central hole therein of reduced diameter compared to said bottom, a flexible slitted flat diaphragm which in use abuts said flat bottom with said central hole being in registry with the slit in said flat diaphragm to form a back check valve integral with said tank, a pump mechanism including a deformable nozzle in fluid communication with said tank for dispensing soap from said tank in discrete doses and a cover removably mounted on said tank, the pump mechanism is slid into the L-shaped bracket and combined with the tank so that the back check valve is integral with the tank.

2. A dispenser according to claim 1, wherein said side walls and front wall extend downwardly past said bottom wall to form a compartment for housing at least a part of said pump mechanism.

3. A dispenser according to claim 1, wherein said tank has mounting means projecting to a predetermined height from the tank bottom wall to support a refill cartridge placed thereon at said predetermined height; said mounting means having a piercing means to open the cartridge at a level from the tank bottom higher than said predetermined height, said mounting means providing communication between the opening cartridge and the pump mechanism, and reinforcing means for said mounting means to position a refill cartridge with respect to said piercing means.

4. A dispenser according to claim 3, wherein said mounting means is C-shaped in horizontal cross-section, with the open portion of said C facing toward said pump mechanism.

5. A dispenser according to claim 3, wherein said reinforcing means comprises upwardly projecting ribs from the bottom of said tank, said ribs having a portion thereof inclined toward said piercing means and having the top surfaces thereof at a level from the bottom of the tank higher than said predetermined level.

6. A dispenser according to claim 5, wherein said tank has a longitudinal slit in at least one lateral wall, said slit extending from the tank top to a level slightly higher than the predetermined height.

7. A dispenser according to claim 3, wherein said tank has at least one rib for positioning a correspondingly shaped cartridge at the inside thereof.

8. The dispenser of claim 3 and further comprising a cartridge for feeding liquid soap into said dispenser, said cartridge being housed in said tank having an outlet neck and a sealing cap suitable to be opened by said piercing means to allow the liquid to flow to said predetermined height from the bottom of the tank.

9. The dispenser of claim 8 wherein said cartridge is generally parallelepiped in shape having at least a side wall formed with a groove therein complimentary in shape to said ribs.

10. A dispenser according to claim 1, further comprising a coupling ring for connecting together an upper portion of the nozzle and said cylindrical projecting portion of said tank.

11. A dispenser according to claim 10, wherein said coupling ring is an internally threaded ring and said cylindrical portion has a corresponding external thread.

12. A dispenser according to claim 1, wherein said pump mechanism includes an actuating member and a piston having one end to effect a pushing action onto a lateral wall of the nozzle and an opposite end shaped to be fitted into a corresponding aperture in said actuating member, and spring means between said piston and said bracket.

13. A dispenser according to claim 1, wherein said tank has a hook-shaped portion on a wall and a recess on the opposite wall to cooperate respectively with a recess and an inwardly extended rib on said cover to maintain said cover on the tank.

* * * * *